United States Patent [19]

Kosrow et al.

[11] 4,038,931

[45] Aug. 2, 1977

[54] FABRIC PANEL DISCONTINUITY SENSOR

[75] Inventors: Robert Leslie Kosrow, Hoffman Estates; Robert Emmet Smith, Crystal Lake; Robert Clarence Talsma, Glen Ellyn, Benjamin T. Bernstein, Highland Park, all of Ill.

[73] Assignee: Union Special Corporation, Chicago, Ill.

[21] Appl. No.: 635,200

[22] Filed: Nov. 25, 1975

[51] Int. Cl.[2] ..... D05B 69/36

[52] U.S. Cl. ..... 112/272; 250/562; 112/277

[58] Field of Search ..... 112/219 A, 121.11, 203, 112/205, 121.12, 121.29; 250/562; 214/1 PE; 271/258

[56] References Cited

U.S. PATENT DOCUMENTS

| | | | |
|---|---|---|---|
| 3,363,107 | 1/1968 | Martin, Jr. | 250/562 |
| 3,433,187 | 3/1969 | Haefele et al. | 112/203 X |
| 3,489,113 | 1/1970 | Flanagan | 112/203 X |
| 3,799,084 | 3/1974 | Furnari | 112/121.11 |
| 3,841,761 | 10/1974 | Selgin | 250/562 X |

*Primary Examiner*—Werner H. Schroeder
*Assistant Examiner*—Peter Nerbun
*Attorney, Agent, or Firm*—John A. Schaerli; John W. Harbst

[57] ABSTRACT

Sensor including a non-contact proximity sensor, proportional change detector system and a sample gate. The machine logic program of the Automatic Sewing System generates a signal which enables the sample gate, at given times during the work cycle. The sample gate also receives a signal indicating fabric discontinuities which is generated by the sensor element. When such input signals are present, at the sample gate, an output is generated thereby to overcome the fabric discontinuities problem.

10 Claims, 4 Drawing Figures

FABRIC PANEL DISCONTINUITY SENSOR

This invention relates to an Automatic Sewing System having a device which monitors a fabric panel for discontinuities therein.

In the apparel industry the present trend is toward the automation of the apparel manufacturing process. That is, for various reasons the procedures in the manufacture of garments, etc., are being automated whereby employing equipment which necessitates the minimum use of manual labor. The different types of such automated equipment is limited only by the particular type of function or job thereunder consideration and the ingenuity of the parties involved. A common problem, however, with any type of automatic sewing system equipment is that associated with the handling of the fabric plies or panels. For the most part the ply during the work cycle is moved, turned, pulled, twisted, pushed, etc., such that the desired work function can be performed thereupon. As a result of the moving, turning, pulling, twisting, etc. the workpiece, at times, has a tendency to fold or crease thus causing a discontinuity in the thickness of the workpiece as it is fed to the workstation. A great many devices have been developed to insure that the fabric ply is in the proper orientation for the performance of the desired function. These developments, however, are not always foolproof.

The problems are better appreciated by the realization that a given automatic sewing system may be required to handle fabric panels which vary from very light polyester pant materials to extremely heavy corduroy or velvet fabric panels with only a bare minimum of manual adjustment. As a result, it has been found necessary to provide most automatic sewing systems with some sort of sensor or detector which detects when, for whatever reason, the fabric has not been orientated, etc., in the proper manner. Such disorientations would include folds, creases, bunching, etc. as mentioned earlier.

It is a major difficulty providing such a fabric discontinuity detecting device, while is capable of handling a very large spectrum of fabric panels, as mentioned above from a very light pant material to the very heavy corduroy and velvet pant material. Another difficulty comes about because of the very high speeds at which automatic sewing systems often run. Thus, the fabric discontinuity detector must detect the fold or crease or whatever and take the necessary corrective steps before the damage has been done. Since very often the sewing head of the automatic sewing system runs at anywhere from 3,000 to 8,000 stitches per minute this difficulty can be appreciated. Another problem comes about because of the very high cost of fabric. Even if the percentages of misses of the fabric discontinuity detector is very small, such as 1 or 2 per cent, it can still constitute a very substantial dollar figure on a weekly basis.

It is therefore an object of this invention to provide a self-compensating fabric panel discontinuity sensor means which can sense fabric discontinuities in fabric panels which range from light suit material to heavy corduroy and velvet with an absolute minimum of manual adjustment. Still another object of this invention is to provide a fabric discontinuity sensor means which has a minimal reaction time from the detection of the fabric irregularity or discontinuity to the time necessary corrective action is taken. Yet another object of this invention is to provide a sensing means for detecting fabric panel discontinuities which require a minimum of adjustment over a wide range of panel thicknesses. Still another object of this invention is to provide a fabric discontinuity sensor means which can be easily and simply fitted to any type of automatic sewing system wherein fabric panels or plies are handled.

In the invention as herein disclosed, a fabric panel discontinuity sensor means is described. Included therein is a proximity sensor means which includes a proximitor means and a non-contacting probe means and a means operable with said non-contacting probe whereby the distance between the probe means and said means operable can be monitored; a mounting means is included whereby the distance between the probe and said means operable can vary; a signal processing system means modifying output signals from said non-contact discontinuity sensor means; a proportional change detector means which generates an output in response to a distance change; a logic program means capable of generating an output signal which conveys information concerning the work cycle of the automatic sewing system; and a sample gate which generates an output signal in response to an input signal from said proportional change detection means and an enabling signal from such logical program system means. Also included may be an output logic system means which responds to a signal from the sample gate to produce a signal or series of signals to cause the necessary corrective steps or action to be taken by the automatic sewing system.

Other features of the invention will be made apparent from the following detailed descriptions of a preferred embodiment thereof, with certain variations therefrom being suggested.

The preferred embodiment of the invention, and certain variations thereof, are shown in the accompanying drawings in which.

Turning now to the drawings, a preferred embodiment of the invention has been shown in relationship to an Automatic Sewing System for effecting the serging of sections of trousers and the like. This particular type of Automatic Sewing System is manufactured by the Union Special Corporation and identified as machine style 2800B-5. It is further discussed in the U.S. Pat. No. 3,425,369 to Kosrow granted on Feb. 4, 1969.

Figure 1:
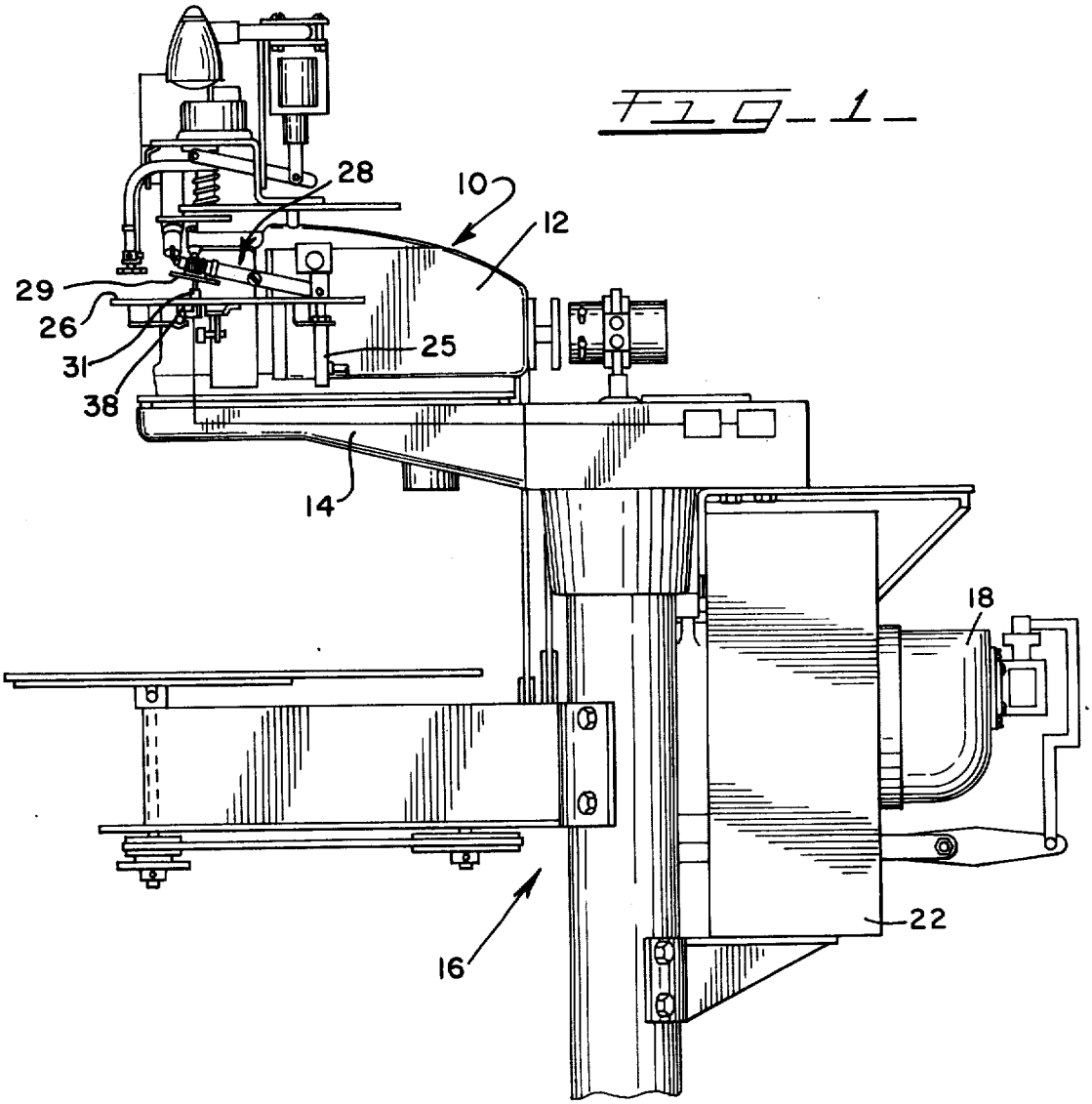
FIG. 1 is a front view of a representative automatic sewing system showing a preferred embodiment of the relative location of the component parts of the invention.

Referring now to FIG. 1, wherein is shown the Automatic Sewing System 10, the sewing machine means 12 is mounted on a table top means 14 carried by a supporting structure 16, an electric transmitter 18 comprising an electric motor and a clutch unit being secured to the under surface of the table top 14. A high torque, low inertia induction motor equipped with a controllable clutch means, a photoelectric control system involving suitable circuits and a photoelectric sensor are included for controlling operation of the motor, (not shown). A switch box and machine logic program means 22 are mounted on the column 16 and secured thereto by suitable brackets. These switches (not shown) and the actual logic hardware (not shown) are employed for the necessary control of the equipment during the work cycle of the Automatic Sewing System. These switches, circuits and logic systems are employed for the proper sequence of events to effect the serging of trouser sections and the like.

Figure 2:
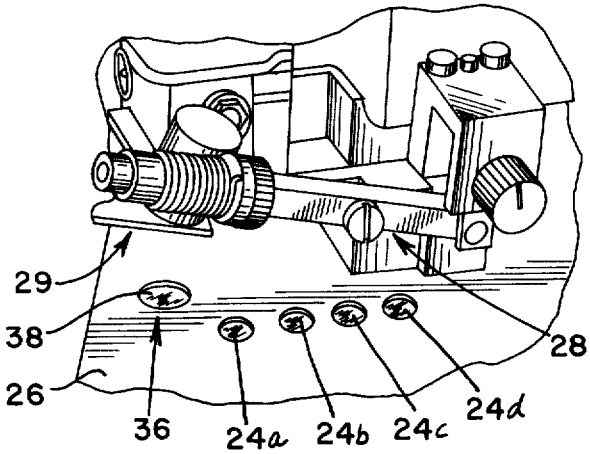
FIG. 2 is an elevational view from the front of the machine as shown in FIG. 1, showing the cloth plate and stripper blade means.

As shown in FIG. 2, a series of photoelectric cell means *24a–d* are located in the cloth plate means 26 whereby some of the input information to the machine logic program is gathered. Directly adjacent the photoelectric means *24a–d* and pivotally mounted with regard to the cloth plate 26 is a fabric following or stripper blade means 28. As designed, the stripper blade 28 can be pivotally moved into a position whereby the major plane of the bottom surface 29 will be substantially parallel with the major plane of the cloth plate means 26 and spaced therefrom. In this embodiment the stripper blade means 28 helps to guide the panel and remove folds therefrom, as the panel is being moved in the direction of the arrow 36 (FIG. 2). In practice, the stripper blade is urged against the cloth plate means 26 by a single acting pneumatic cylinder means 25 (FIG. 1). During a work cycle wherein a fabric panel is passing over the cloth plate 26, and said fabric panel is being urged in this direction by the action of the feed dog (not shown) into the stitch forming instrumentality 31 which in this case is a needle means, the bottom surface 29 of the stripper blade 28 as in immediate contact with the fabric panel just prior to work being performed thereon. The fabric panel as it passes over the cloth plate 26 after passing under the bottom surface 29 of the stripper blade 28 has a substantially uniform continuity. As a result, just prior to any work being performed on the fabric panel there are no discontinuities such as bends, folds, bunches, etc., in the fabric panel. The fabric is smooth. This, of course, is the ideal situation.

In practice, as previously stated, discontinuities often do pass under the stripper blade 28 or other device or devices employed to remove them. They then pass into the region wherein work is performed on them which is usually of a damaging nature.

For further information on the functioning of the particular Automatic Sewing System 10 shown here, reference should be made to the above identified Kosrow patent as well as to the sewing machine 12, which is of the overedge type manufactured by Union Special Corporation under the designation 39500 QJZ.

In the particular embodiment of the fabric discontinuity sensor means adapted for employment with this particular Automatic Sewing System, a probe means 38 of a non-contact proximity sensor means 44 is mounted in the cloth plate 26 below the bottom surface 29 of the stripper blade 28. The non-contact proximity sensor means 44 including the probe and the proximitor is a well known and commercially available unit and can be purchased from Bently Nevada, P. O. Box 157, Minden, Nev. 89423. The Bently non-contacting, eddy current probe is a gap to voltage transducer. The probe as seen by the operator is that round circular disc generally indicated as 38 in FIG. 2. The probe is used to measure distance, and change in distance, to any conductive material i.e., steel. The term non-contacting is associated with the probe means not contacting a conductive material such as steel, whereas in fact the probe does contact the fabric as will be described hereinafter. The actual transducer is a flat coil of wire, located on the end of a ceramic tip. The coil is protected by 0.010 inches of epoxy fiberglass, and is not visible. The ceramic tip extends out from the steel body of the probe which, as mentioned above, is located on the underside of the cloth plate shown in FIG. 2. The probe is driven by an RF voltage generated by the Bently proximitor. The signal output from the proximitor is a voltage proportional to the gap between the probe and the observed surface, which in the present invention is the bottom surface 29. The non-contact proximity sensor means 44, as mentioned above includes probe means 38 and proximitor means 40, with the necessary coaxial extension cable or circuitry therebetween. In operation, the fabric panel lies over the cloth plate means 26 and the stripper blade 28 exerts force there against. It should be noted that the top surface of the fabric panel is in immediate contact with the stripper blade, while the lower surface of the fabric panel is in contact with the top surface of the probe means 38. At the same time the stripper blade 28 shadows or overlies the probe means 38. As the fabric panel is being moved over the cloth plate means the probe 38 continually monitors the distance between the bottom surface 29 of the blade means 28 and itself. That is, the probe 38 and the bottom surface 29 of the stripper blade 28 are so mounted and orientated that when fabric panel discontinuities occur, such as folds, they are swept or pulled under the stripper blade 28 whereby moving the blade means 28 from a given established position. This change in distance between the probe means 38 and the bottom surface 29 is immediately sensed by the probe 38. In this embodiment when the stripper blade 28 is in a raised position a signal is generated which is communicated to the sensor system. A second signal or voltage level is generated when the stripper blade 28 is in the work position or equilibrium position. This second signal is created by the distance the stripper blade 28 moves from its raised position to its work position. Thus, for each different type fabric having different thicknesses the distance moved by the stripper blade 28 moving from its raised position to its work position may be different and the voltage generated will be different. It is this voltage, generated in response to a particular material thickness, which serves as the base line from which change is measured. Therefore it may be said that the System herein employed is a self-compensating system, that is, it needs no adjustment for measuring different fabric thicknesses. As is apparent, this is only a preferred embodiment and the relative relationships of the elements could be varied or for that matter the probe 38 could be used in conjunction with any type of device which would move in response to fabric panel discontinuities. Additionally, the fabric discontinuity sensor is not limited to use with sewing head means. It can be employed in any situation where work is to be performed on a fabric panel which must be in a flat or smooth orientation.

Figure 3:
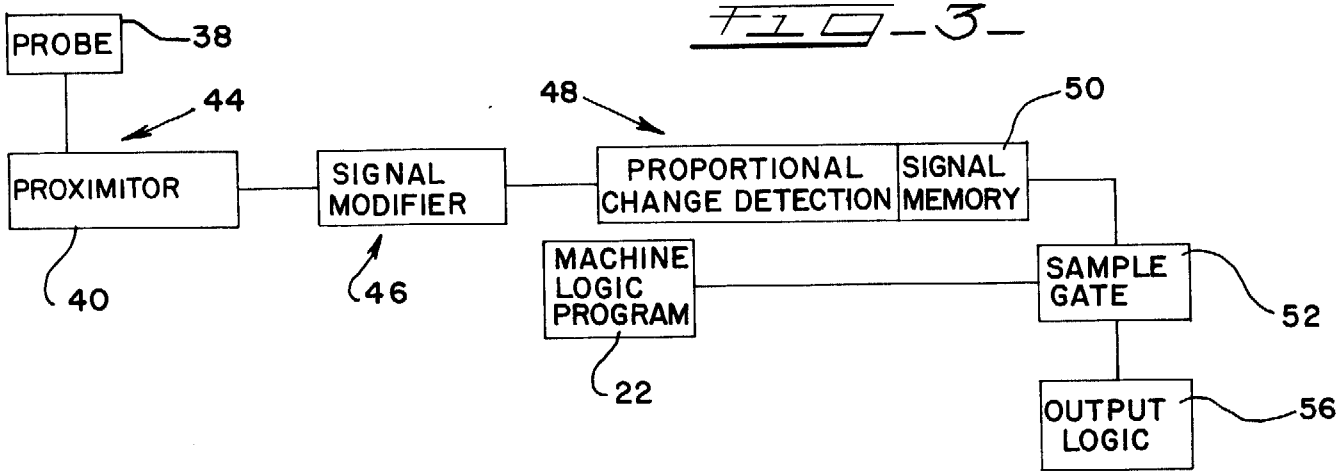
FIG. 3 is a block diagram showing various electrical circuits and devices incorporated herein.

Referring now to FIG. 3, wherein the discontinuity sensing means is shown in block diagrams, the non-contact proximity sensor means 44 as previously stated includes both the probe means 38 and the proximitor means 40. Output signals from the non-contact proximity sensor 44 generated by discontinuities are transmitted to a signal modifying means 46 which modifies the signal in a desired manner. For example, it can be used to make the output signal compatible with the overall system. The modified signal or output from signal modifier 46 is then transmitted to a proportional change detector system means 48 which monitors the incoming signal, compares it to a given value and produces an output only when there is a change of a given size above a set threshold. Thus, the proportionate change detector system means 48 produces an output only in certain circumstances. In actual operation they would be the detection by the probe means 38 of a substantial fabric discontinuity which causes a difference in the distance between the probe means 38 and the bottom surface means 29 and not those caused by loose thread or naturally occurring fabric thickness changes. Included in the proportionate change detector system means 48 is a signal memory means 50 which is capable or retaining the last steady state input information just prior to a fabric discontinuity signal. In the preferred embodiment memory means 50 is a quick change slow discharge capacitor memory means. From the proportionate change detector means 48, a signal representative of a fabric discontinuity passes to the sample gate means 52. The sample gate means 52 is a device wherein a series of input signals are filtered to produce an output to a selected combination. Also, having an input to the sample gate means 52 is the machine logic program means 22. The machine logic program means 22, as previously stated, contains particular information about the machine work cycle and events which occur thereduring. In order for the sample gate means 52 to produce an output it must receive an input from proportionate change detector system means 48 indicative of a fabric discontinuity and simultaneously therewith on enabling input signal from the machine logic program means 22. This enabling signal is necessitated due to the fact that the fabric discontinuity sensed by the probe means 38 may be part of the normal work cycle of the Automatic Sewing System. During this time it would be undesirable in any way to interrupt the work cycle.

It is for this purpose also that this particular discontinuity sensor means includes a memory means. If during the normal work cycle an intentional discontinuity is produced the machine logic program means 22 prevents enabling of the sample gate. However, if an unintentional discontinuity occurs during the normal work cycle, the proportionate change detector system must be able to judge this discontinuity against the threshold set by the smooth fabric. That is, when in the equilibrium or work position such that an output can be sent to the sample gate. For example, during the work cycle the stripper blade 28 is raised to turn the fabric panel. This action may create a fold which would be caught under the stripper blade when it returned to its work position. The memory then supplies information as to the prior state that is, the premeasured distance between the probe means 38 and the bottom surface 29, such that the proportion change detector can function. Only during such work cycle produced discontinuities, would the sample gate be disabled. At all other times it would receive an enabling signal from the machine logic program means.

In the event an output signal is produced by the sample gate means 52, this signal, depending on the complexity of the Automatic Sewing System, will be transmitted to an output logic means 56. The output logic means 56 may simply be a switch which deactivates the Automatic Sewing System or it may be a rather complex system which causes corrective action to be automatically taken. As is apparent, the particular nature of all the above listed comments can be varied depending on the Automatic Sewing System. The machine logic program means 22 itself varies for practically every type of Automatic Sewing System. Also, the output logic means 56 could be a matter of choice or operator ability, etc.

Figure 4:
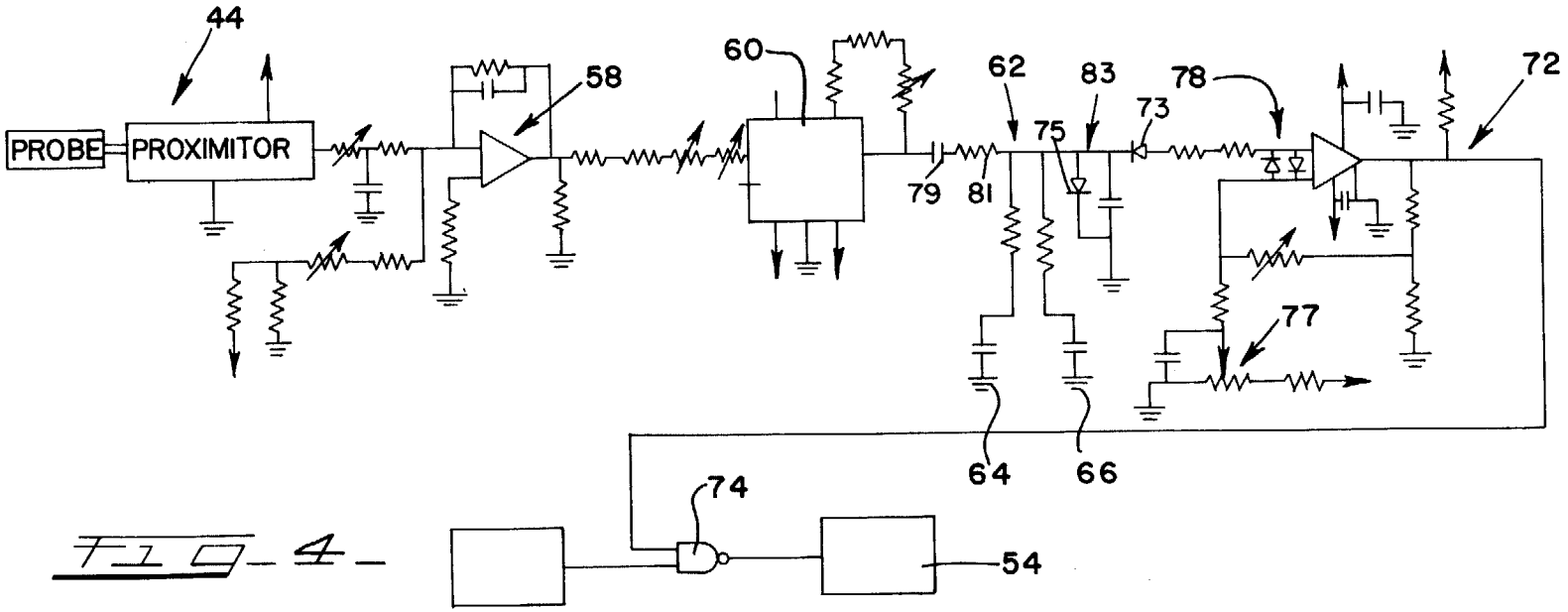
FIG. 4 is an electrical diagram showing a proximity sensor means, a signal processing system, a proportional change detector, a signal memory and sample gate in greater detail.

Referring now to FIG. 4, in the preferred embodiment one particular form of the fabric discontinuity sensor means is shown. It should be noted, however, no attempt has been made to disclose a circuit design of either the machine logic program means 22 or the output logic 56 since these would vary drastically from one particular Automatic Sewing System to another. Various types of non-contact proximity sensor means can be employed depending on the particular model of transducer and the particular type of probe head as well as the length of lead therebetween. These different variables may be interchanged until the desired combination is arrived at.

Turning now to FIG. 4 where there is shown a schematic diagram of the associated circuitry employed with the present invention the output signal from the particular non-contact proximity sensor 44 herein employed is negative. Since it is necessary to maintain a base signal over the system, a signal modifier means 58 is employed. The modifier means 58 inverts the signal received from the discontinuity sensor means 44 and maintains a base line voltage over the system, via the associated circuitry. It also amplifies the signal so that the output to means 60 is of the right polarity and right magnitude.

The continuous output from the signal modifier means 58 constitutes the input to a proportional change detector system means, which in the embodiment includes the following elements:

First, the input is inverted by a log amplifier means 60, the function of which is explained by the following series of equations:

$$E_{OUT} = -A(\text{LOG } I_{IN} - \text{LOG } I_{REF})$$

$$E'_{OUT} = -A(\text{LOG } I'_{IN} - \text{LOG } I_{REF})$$

$$E'_{OUT} - E_{OUT} = \Delta E = A \text{ LOG } 2$$

wherein: $E_{OUT}$ is the steady state output of the log amplifier, $E'_{OUT}$ is the output after the change, A is an adjustable constant, $I_{REF}$ is a reference current, $I_{IN}$ is the initial current input and $I'_{IN} = 2I_{IN}$ is the current in after the change, which in this particular example is a fold wherein the thickness is doubled. This particular Log amplifier is purchased from Teledyne Philbrick of Allied Drive at Route 128, Dedham, Mass. 02026. In these equations $E_{OUT}$ is a steady state DC signal stage, as is $E'_{OUT}$ while $\Delta E$ represents a signal change. This results because a DC signal does not pass through a capacitor such as in means 62. Thus, the output is in the form of a pulse signal which is representative of a certain amount of fabric discontinuity measured by the distance between the non-contact proximity sensor means 44 and the bottom surface 29.

In operation the log amplifier means 60 in response to an input signal establishes a steady state signal. In the preferred embodiment this steady state can vary between zero to $-10$ volts. This voltage represents a distance D which is the distance the stripper blade moves from its raised storage position to the point where it engages the surface of the fabric panel with the more negative voltage being the raised position. Thus, when the stripper blade is raised during the work cycle by the machine logic program means 22 and then lowered, a different signal will be produced, unless the second D value is the same as the first D value stored in the memory 50. This change could be caused by the creation of a fabric discontinuity by this particular step of the machine work cycle.

Depending on the system design, this signal can then be passed through a comparator means, such as means 72, which in turn may or may not generate an impulse to sample gate 74. Or the signal can be directly passed to the sample gate 74. When the change in the distance D is a function of the machine work cycle, the sample gate 74 is not enabled by the machine logic program 22. However, if the distance D change is caused by an actual fabric discontinuity having nothing to do with the machine work cycle, because of machine logic program 22, sample gate 74 will be in an enabled state. The output therefrom will cause the desired Automatic Sewing System corrective action to be taken.

As previously stated in the preferred embodiment as shown in FIG. 4, the output signal from the log amplifier means 60 passes into a quick change slow discharge capacitor resistor combination means 62 which serves the function of the signal memory 50 in FIG. 3. Included in the combination means 62 are capacitor means 79, resistor 81, steering diode means 73 nd 75 and the circuitry 83. Diode means 73 is employed in changing and diode means 75 is involved in discharge. Next in the circuit are first and second contact means 64 and 66 which serve to drain off signal from the combination means 62. The machine logic program means 22 operates to control contact means 64 in response to the end of the work cycle. Contact means 66 is controlled by output logic means 56 as part of the correction action. In the preferred embodiment, contact means 64 involves the use of a 10K resistor which quickly drains off of the signal stored in combination means 62. Contact means 64 is employed at the end of the machine cycle such that the machine can be immediately restarted without creating confusion in the value of E′ as shown in the above identified equation. The second contact means 66 involves a one Meg resistor that results in a slower current drain. This slower drain off is such that the Automatic Sewing System can be reset but not too quickly. Thus, the operator cannot restart the machine before the fabric discontinuity problem has been corrected.

It is to be understood that this is only a preferred type of proportional change detector system. Any device of the nature wherein there is a definite relationship between the control output and signal input i.e., as against an on/off type device would be satisfactory.

In the particular embodiment shown, a reference signal or threshold signal is set manually via the use of a potentiometer or a series of potentiometer means 77. Since the input signal involved at this state is slightly negative or zero, and the reference signal is a given negative value, the input signal must be more negative before an output will be generated. That is, the reference signal constitutes a threshold and if an input signal comes in higher in a more negative sense, the comparator means 72 generates an output. The proportional change detector means 48, thus generates an output only when the input is in a negative sense, above a given level and so avoids any problems with attempting to measure absolute values. It should be noted that the signal in practice varies between zero volts and −10 volts. In the event there is an output signal from the proportional change detector system means, the signal is transmitted to the sample gate means 74 which in the preferred embodiment is a NAND gate. The NAND gate is connected on its other end to the machine logic program means 54.

Thus it is apparent that there has been provided, in accordance with the invention, a Fabric Panel Discontinuity Sensor that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An Automatic Sewing System having a work cycle during which work is performed on a fabric means and a machine logic program means capable of generating output signal means conveying information, including a sensing means monitoring said fabric means for discontinuities comprising:

a self compensating fabric contacting proximity sensor means capable of producing a first value means in response to fabric discontinuities;

a proportional change detector system means receiving said first value means from said proximity sensor means, said system means including means for comparing said first value means with a second value means whereby producing a third value means when said first value means does not approximately equal said second value means; and a sample gate means for generating a fourth value means when enabled by said machine logic program means, in response to said third value means.

2. The sensing means of claim 1 including:

a signal memory means; and an output logic means receiving said fourth value means from said sample gate means.

3. The sensing means of claim 1 wherein:

said self-compensating fabric contacting proximity sensor means includes a probe means and proximitor means;

said proportional change detector system means includes a signal memory means and a comparator means.

4. The sensing means of claim 3 wherein:

said probe means is mounted with respect to said Automatic Sewing System whereby fabric discontinuities produce movement therebetween.

5. The sensing means of claim 4 including:

an output logic means receiving said fourth value means from said sample gate means whereby controlling said Automatic Sewing System to correct for fabric discontinuities.

6. An Automatic Sewing System comprising:

a sewing machine means including a motor means for driving said sewing machine, a control means actuating or deactuating said motor, a stitch forming instrumentality, a cloth plate means;

a fabric panel detection means, including a series of photoelectric means capable of detecting the presence or absence of a fabric panel;

a fabric contacting proximity sensing means located generally in front of said stitch forming instrumentality:

an output logic means receiving input from said fabric panel detection means and said proximity sensing means; and said proximity sensing means and said cloth plate means having mounting means for measuring movement between said proximity sensing means and said cloth plate means and means for comparing this movement with a preset value, the movement being generated by fabric panel discontinuities.

7. An Automatic Sewing System for performing work on a fabric panel means, having a sequential machine logic program, for producing signals to run said system, a fabric discontinuity sensing means monitoring the fabric panel and capable of overriding the control of said Automatic Sewing System comprising:

a self compensating fabric contacting proximity sensor means, including a probe means located generally in front of the stitch forming instrumentality of said Automatic Sewing System;

a proximitor responsive to discontinuities of said fabric panel for measuring the relative distance between said probe means and a given point and for producing a signal means when said measured distance is greater than a preset value; and means accepting said signal means being generated by said proximitor means and for accepting said sequential machine logic program means signal said signals are simultaneously accepted and indicate the occurrence of.

8. An Automatic Sewing System having a work cycle during which work is performed on a fabric means, including a sensing means monitoring fabric continuity and being capable of causing overriding control of said sewing machine comprising:

a self compensating fabric contacting proximity sensor means, including: a probe means, a moveable guide means operative with said probe means whereby the distance therebetween is measurable, and a proximitor means for measuring the distance between said probe means and said moveable guide means, said proximitor means including means for producing a first signal means reflective of said measured distance;

a signal modifier means, modifying said first signal means of said proximity sensor means;

a machine logic program means capable of generating a second signal means conveying information concerning the work cycle of the Automatic Sewing System;

a proportional change detector system means receiving said first signal means from said signal modifier and generating a third signal means characterized by discontinuity of said fabric means; and a sample gate means generating a fourth signal means in response to an input signal from said proportional change detector system and an enabling input signal from said machine logic program means.

9. The sensing means of claim 8 further including:

an output logic means responsive to an output from said sample gate means capable of producing a signal causing a desired Automatic Sewing System response.

10. An automatic machine means having a work cycle during which work is performed on sheet-like means and machine logic program means capable of generating output signal means conveying information, including a sensing means monitoring the sheet-like means for discontinuities comprising;

a self compensating fabric contacting proximity sensor means capable of producing an output in response to discontinuities in said sheet-like means of varying thickness;

a proportional change detector system means receiving input from said proximity sensor means and producing an output when said input represents a rapid change; and a sample gate means generating an output signal, when enabled by said machine logic program means, in response to an input from said proportional change detector system means.

* * * * *